US009718101B2

(12) United States Patent
Doyle et al.

(10) Patent No.: US 9,718,101 B2
(45) Date of Patent: Aug. 1, 2017

(54) METHOD AND DEVICE FOR CLEANING AND/OR DISINFECTING SURFACES

(71) Applicant: ZOBELE ESPAÑA, S.A., Barcelona (ES)

(72) Inventors: Dominic Doyle, Barcelona (ES); Julio Ruiz Ballesteros, Barcelona (ES)

(73) Assignee: ZOBELE ESPANA, S.A., Barcelona (ES)

( * ) Notice: Subject to any disclaimer, the term of this patent is extended or adjusted under 35 U.S.C. 154(b) by 52 days.

(21) Appl. No.: 14/433,319

(22) PCT Filed: Sep. 26, 2013

(86) PCT No.: PCT/EP2013/070072
§ 371 (c)(1),
(2) Date: Apr. 2, 2015

(87) PCT Pub. No.: WO2014/053390
PCT Pub. Date: Apr. 10, 2014

(65) Prior Publication Data

US 2015/0258580 A1 Sep. 17, 2015

(30) Foreign Application Priority Data

Oct. 4, 2012 (EP) ..... 12187190

(51) Int. Cl.
*B65D 83/00* (2006.01)
*E03D 9/02* (2006.01)
(Continued)

(52) U.S. Cl.
CPC ..... *B08B 3/026* (2013.01); *B05B 11/0054* (2013.01); *B05B 11/3011* (2013.01);
(Continued)

(58) Field of Classification Search
None
See application file for complete search history.

(56) References Cited

U.S. PATENT DOCUMENTS 3,084,872 A 4/1963 Corning
3,168,984 A 2/1965 Corning et al.
(Continued)

FOREIGN PATENT DOCUMENTS

DE 1076585 2/1960
DE 3712802 C1 6/1988
(Continued)

OTHER PUBLICATIONS

DE 19738039 English Translation, accessed on Nov. 2016.*
Search report and written opinion issued by EPO dated Dec. 20, 2013.

*Primary Examiner* — Eric Golightly
*Assistant Examiner* — Arlyn I Rivera-Cordero
(74) *Attorney, Agent, or Firm* — Michael B. Fein; Eckert Seamans Cherin & Mellott, LLC

(57) ABSTRACT

The present invention relates to a device for cleaning and/or disinfecting surfaces, particularly for cleaning inner surfaces of the toilet bowl. The device comprises an elongated housing connected to a bottle with the cleaning and/or a disinfecting liquid, and a pumping mechanism for pressurizing said liquid composition, and at least one nozzle for the output of said liquid composition, wherein the nozzle is in fluid communication through a conduit of the device with said pumping mechanism. The pumping mechanism is provided at one side of said housing and said at least one nozzle is provided at the opposite side of the housing.

6 Claims, 4 Drawing Sheets

(51) Int. Cl.

| | |
|---|---|
| ***B08B 9/093*** | (2006.01) |
| ***B08B 9/04*** | (2006.01) |
| ***B08B 3/02*** | (2006.01) |
| ***E03D 9/00*** | (2006.01) |
| ***B08B 3/08*** | (2006.01) |
| *B05B 11/00* | (2006.01) |

(52) U.S. Cl.
CPC ..... *B08B 3/08* (2013.01); *E03D 9/00* (2013.01); *B05B 11/0037* (2013.01); *B05B 11/3045* (2013.01)

(56) References Cited

U.S. PATENT DOCUMENTS

| | | | | |
|---|---|---|---|---|
| 3,178,070 | A | 4/1965 | Leland | |
| 3,199,739 | A | 8/1965 | Corning et al. | |
| 3,595,441 | A * | 7/1971 | Grosjean | B65D 1/0292 222/107 |
| 4,777,670 | A | 10/1988 | Klinkhammer et al. | |
| 5,611,465 | A | 3/1997 | Lee et al. | |
| 6,178,564 | B1 | 1/2001 | Leonard et al. | |
| 6,230,334 | B1 | 5/2001 | Camp et al. | |
| 8,099,800 | B2 * | 1/2012 | Sawalski | B65D 83/20 4/223 |
| 8,220,080 | B2 | 7/2012 | Sawalski et al. | |
| 2002/0170988 | A1 * | 11/2002 | Norville | B05B 11/0005 239/587.1 |
| 2006/0124662 | A1 * | 6/2006 | Reynolds | A47K 5/1217 222/23 |
| 2009/0032618 | A1 * | 2/2009 | Hornsby | B05B 1/3436 239/333 |
| 2011/0024466 | A1 * | 2/2011 | Mazooji | B05B 3/02 222/325 |
| 2011/0180101 | A1 * | 7/2011 | Konishi | A47L 13/26 134/6 |

FOREIGN PATENT DOCUMENTS

| | | | |
|---|---|---|---|
| DE | 19738039 | A1 | 3/1999 |
| WO | 99/66139 | A1 | 12/1999 |
| WO | 99/66140 | A1 | 12/1999 |
| WO | 2011/090823 | A2 | 7/2011 |

* cited by examiner

METHOD AND DEVICE FOR CLEANING AND/OR DISINFECTING SURFACES

CROSS-REFERENCE TO RELATED APPLICATIONS

This application is the U.S. national stage of PCT/EP2013/070072 filed Sep. 26, 2013, which claims priority from EP application 12187190.9 filed Oct. 4, 2012, both of which are hereby incorporated by reference.

OBJECT OF THE INVENTION

The present invention relates to a device for cleaning and/or disinfecting surfaces and particularly but not exclusively, for cleaning inner surfaces of the toilet bowl, including under the toilet bowl rim, and treating toilet bowl surfaces to remove contaminants, bacteria and/or malodour as well as introduce a treatment agent and/or air freshening agent thereto.

BACKGROUND OF THE INVENTION

Toilet bowls are generally connected to water supply connections, and flushing a toilet bowl can be accomplished automatically or by pressing a handle. However, the stain and the bad odour of a toilet bowl cannot be eliminated by flushing with clean water. The effect from flushing with clean water is usually not remarkable.

Toilet bowls require care to prevent the buildup of deposits and/or bacteria growth and to reduce bad odors. Traditionally, toilet bowls are cleaned and disinfected manually with cleaning and/or sanitizing agents and manual hand work. This is a hard and not desirable labor that people don't like.

In order to eliminate this undesirable task various toilet bowl cleaners have been proposed in the past, for example U.S. Pat. No. 4,777,670. In fact are well known in the market the products used for toilet cleaning and disinfection that avoid manual scrubbing. One type of dispenser comprises a solid block of cleansing and freshening substances that are suspended from the rim of a toilet bowl in a container that is placed in the path of the flushing water. A portion of the solid block is delivered into the toilet every flushing.

Other toilet bowl cleaning solutions use a liquid cleaning substance that is delivered into the toilet bowl. For example U.S. Pat. No. 6,178,564 and U.S. Pat. No. 6,230,334, and PCT International Publication Nos. WO 99/66139 and WO 99/66140 all devices or substances that are capable of being suspended from the rim of a toilet bowl.

Other toilet bowl devices use an aerosol that is delivered through a conduit attached to the toilet bowl rim. For example U.S. Pat. No. 3,178,070.

Trigger-sprayer bottles represent a very recognizable packaging for spray cleaning products. Trigger sprayers were developed decades ago by companies as AFA Corp, Owens, and Calmar, and now these sprayers are very conventional and familiar, available at low cost from many distributors. Usually these devices are a combination of a blow-molded bottles, with conventional trigger sprayer, and a straw-type dip-tube positioned down into the bottle. However, these devices cannot be used to spray in areas as under toilet bowl rim due to his ergonomie. As a possible solution inverted spraying has been described in the prior art. For example U.S. Pat. No. 6,293,441 (Tasaki et al.); U.S. Pat. No. 5,979,712 (Montaner et al.); U.S. Pat. No. 5,775,548 (Hohmann et al.) and WO2011/090823 (PCT/US2011/020304) each describe invertible sprayers.

Although, as we have seen, there are various treatments, devices and systems commercially available to address the root of the toilet cleaning, the present invention is concerned with a cost-effective device that is capable of delivering a cleaning and/or refreshing and/or sanitizing substance in a upright position, wherein the device is configured to be operated more efficiently to improve the cleaning, it is more user convenient and more efficient that previous devices.

Drawbacks of the existing solutions that will be solved with our invention:

An embodiment of a toilet cleaner device as is set forth in the foregoing is known from U.S. Pat. No. 5,611,465. The known toilet cleaning device constitutes an integrated device having an automatic liquid soap dispenser and a guided flow tube. The dispenser is provided with a timer-activated device, and the guided flow tube is connected to the water supply connection of the toilet bowl. The liquid soap is squeezed through the guided flow tube into the water supply connection, thereby allowing the water to be mixed with the liquid soap for flushing and cleaning the toilet bowl.

It is a disadvantage of the known toilet cleaner device that in order to do his task it works automatically that means to lose efficiency. Several doses could be applied one over the other without flushing, just wasting a lot of active substance and harming the environment.

Other solutions as proposed on U.S. Pat. No. 4,777,670, U.S. Pat. No. 6,178,564 and U.S. Pat. No. 6,230,334, and PCT International Publication Nos. WO 99/66139 and WO 99/66140, are toilet rim mounted and they have not access with the chemical ingredients to hidden surfaces in the toilet bowl reducing dramatically the efficacy of the solution. The present invention is user-controlled, and for this reason the user can apply the chemical agent in the area where bacteria's or contaminants are building up.

Other solutions as U.S. Pat. No. 8,220,080 they have not solution for user interaction with the device in case that device is fit permanently or temporally inside the toilet bowl or device could be in contact with dirty and/or unsafe and/or unsanitized areas. The present invention has specific solutions in order user is not forced to touch product areas that have been in contact with unsafe toilet bowl surfaces due to his upright position use.

DESCRIPTION OF THE INVENTION

It is an object of the invention to provide a cleaning and/or disinfecting device efficient, effective and user convenient that can works in an upright position, with the trigger system in the upper part of the device and the chemical output close to the bottom side of the device.

It is a still further object of the invention to provide a device for cleaning inner surfaces of toilet bowl and treating toilet bowl surfaces to remove contaminants, bacteria and/or malodour as well as introduce a treatment agent and/or air freshener thereto.

To this end the device according to the invention comprises:

A handle to hold the device;

a trigger to activate the delivering of the substance, a fluid dispensing pump that may be used to pump fluid from a container to the sprayer of the invention.

a sprayer, a container for the chemical substance that will be delivered,

A protection for childproof use.

The device has an ergonomic handle that allows to be used only with one hand. The manual trigger is placed in a position just to avoid user to put the hand inside the toilet.

The container has a relatively flat bottom that allows maintaining the device upright. The bottom of the container is in contact with the surface over the device is rested. The sprayer is allocated near the bottom side but not in contact with the surface over the devise is rested.

The fluid container is replaceable.

When an user presses the trigger, the fluid dispensing pump sucks the liquid from the container and send it, thought a pipe, to the sprayer.

Key Aspects:

The invention has the trigger system and the handle support in the upper part of the device with the chemical output in the bottom side of the product, just to be used in a upright position improving the efficacy, performance and usability thanks to this ergonomic design that allow to spray directly over the dirty and hidden areas of the toilet bowl without to introduce the user hands inside the said toilet bowl.

Then invention could have the sprayer 90° direction from the trigger movement for user convenience (usability)

The invention could have a system to avoid that user can refill the fluid container The invention could have a system to remove the fluid container without to touch it.

The invention could be used by user in terms to deliver chemical agent in any part of the toilet bowl: Any point above the toilet waterline, any point at the toilet waterline, and/or locations under the toilet.

The invention could have a special spraying pattern that helps the user to cover 100% of the inner surface of toilet bowl.

The invention could have a fluid dispensing pump that can deliver liquids with a very good repeatability, consistency and long life for best efficacy and efficiency of the product.

The invention could have a system to avoid the leakage of the bottle if the device is used up-side-down.

The invention could have a system for childproof protection.

The invention can mist, spray and/or foam the chemical product by a selector.

The invention can include a detachable brush accessory

The invention can include a folding nozzle cover to avoid user contact and dripping.

Keeping the sprayer in the bottom of device is considered to be particularly advantageous and efficient for several reasons, in particular because user can operate device stand-up in a very ergonomic position. Additionally this position improves the efficacy of the product due to the fact that is possible to spray directly onto the dirty deposits or hidden surfaces areas that are good spaces for bacteria growing.

Preferably the device is manually operated, but alternatively or additionally device could be battery operated with a motorized pump.

Preferably the device has the trigger in the opposite side of the sprayer just to avoid putting the user hand inside the toiled bowl when device operated.

Preferably the liquid container could be replaced when liquid finished.

Preferably the sprayer is perpendicular to the trigger movement direction in order to have an easy dosing on the toiled bowl rim area.

Preferably the sprayer has 3 nozzles in order to reach maximum breadth angle and minimize the number of triggers needed to cover all inside toilet areas. Alternatively 1 nozzle special fan spray pattern will be used.

Users don't want to touch devices areas that have been inside the toilet bowl or in contact with it. Due to the fact that bottle could be in contact with toilet bowl water or toilet bowl surfaces when device in use, is particularly advantageous that the device has a user interface system to detach the container when empty without the need to touch it.

It is preferable to have a pipe from the bottom of the recipient to the pumping system, to facilitate the full emptying of the recipient. Alternatively a recipient with a special output valve and a double internal layer, example bag-in a-bag could be used avoiding the pipe and improving features as the possible leakage of the product.

User observation indicates that sometimes user refill an empty bottle with other chemical liquids. This is a very dangerous practice due to the fact that they can put inside the device a dangerous liquid.

It is preferable to have a mechanical system to avoid that an empty and removed container could be placed again in the device. Container could have a thread that will be broken after be put inside the device. When container removed the threat will be useful for another use.

It is preferable that each activation generates a spray, but alternatively is possible to have a solution where the refill is pressurized, with gas mixed or not with chemical agent, and one trigger activation can deliver several seconds of liquid dosing.

It is preferable that each activation generates a spray, but alternatively is possible to mist or foam the chemical product.

It is preferable that device only spray, but alternatively is possible that device has a detachable or fixed brush accessory.

User insights show that avoid child use of this kind of products is very important for users and consumers due to the fact that this substances are very dangerous for children. Then preferable that product has a child safe system at the sprayer output to close it and avoid spraying. Alternatively or additionally is possible to have a mechanical system to avoid trigger activation by children. Alternatively is possible a mechanical system in the nozzle to avoid children activation.

PREFERRED EMBODIMENTS OF THE INVENTION

Figure 1:
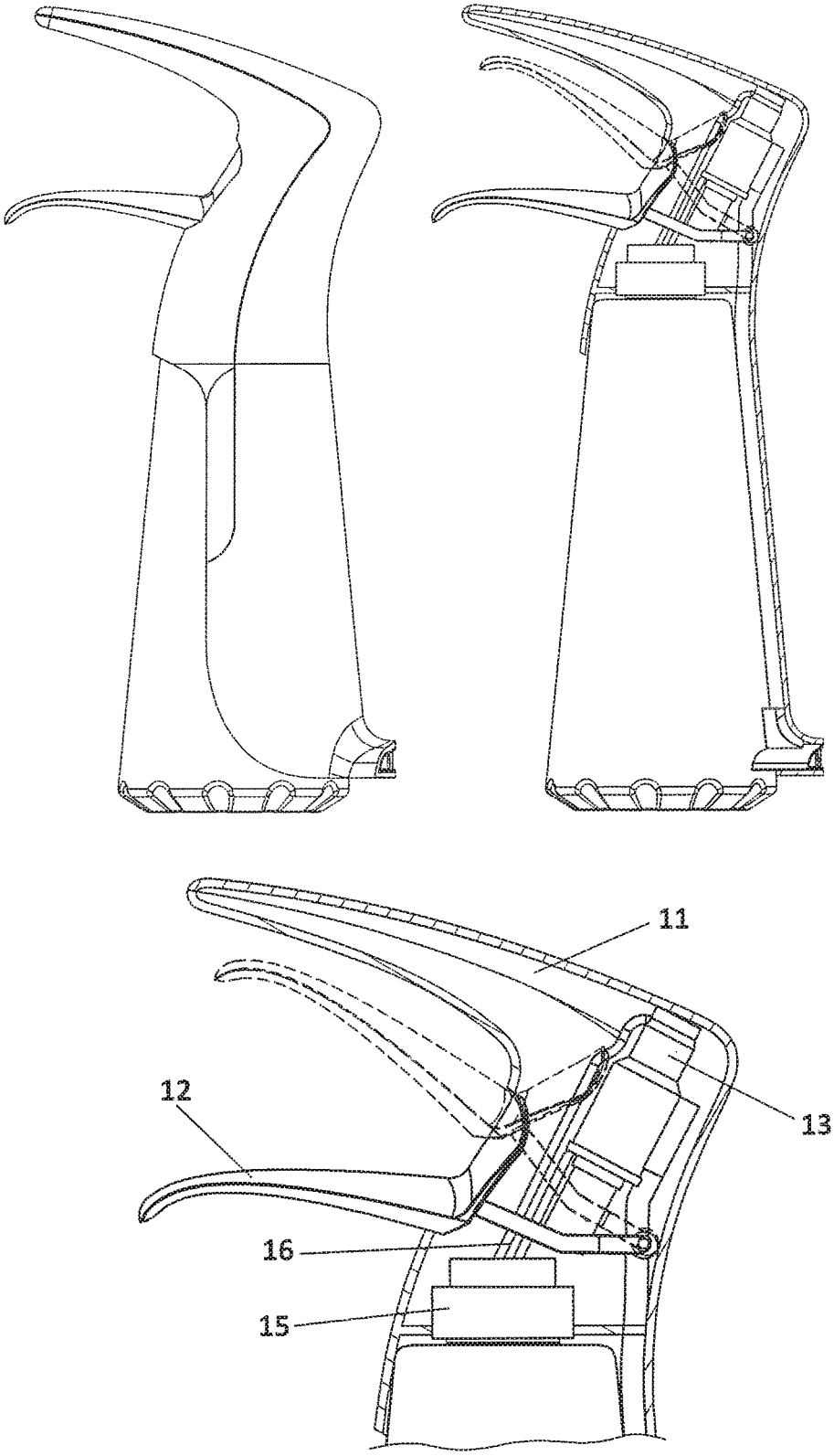
FIG. 1.—is a cross-sectional elevated view of a preferred embodiment of the invention.

FIG. 1 presents a possible realization of the handle 11 and the trigger 12 used by user to dispense chemical product. When user presses the trigger 12 just hanging the device with one hand by the handle 11, the internal pump 13 system is activated. The chemical is carried from the container 15, through a pipe 16, to the pump 13 and at the same time from the pump 13 to the nozzle output, and finally it is sprayed.

Figure 2:
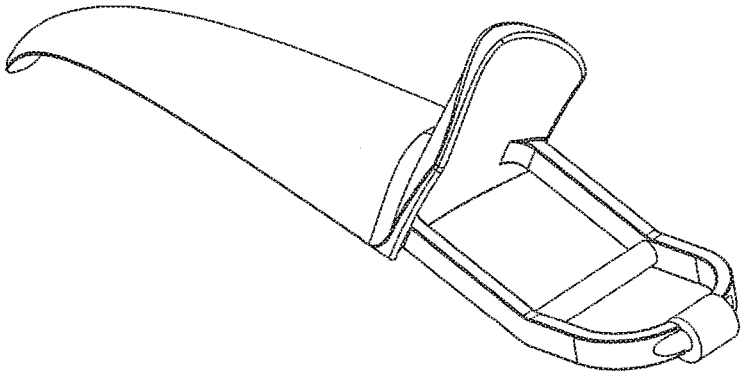
FIG. 2.—is a perspective view of the trigger.

FIG. 2 illustrates a detail of the trigger arm part.

Figure 3:
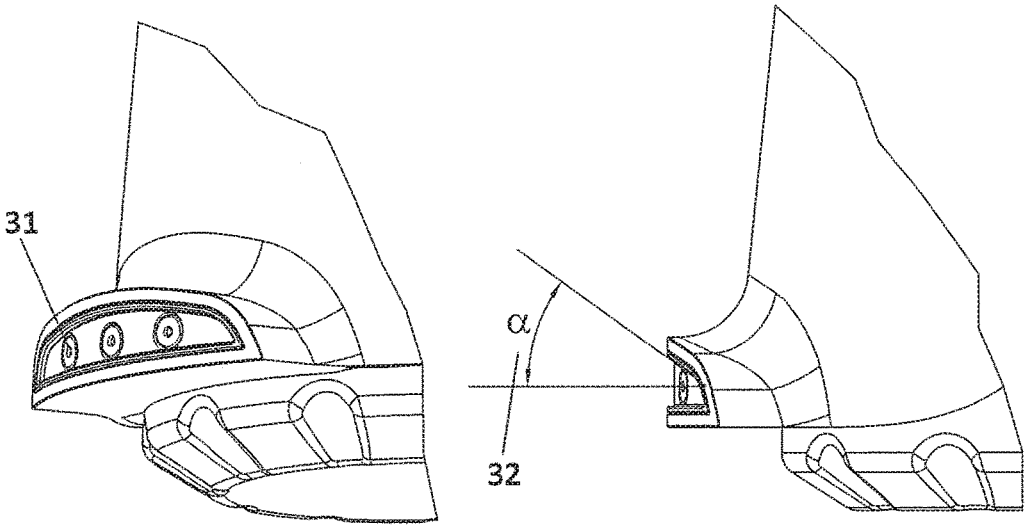
FIG. 3. is a pair of view of the nozzle spray output

FIG. 3 illustrates a detail of the 3 nozzles output 31. In different implementations of the product the nozzles could be in a different angle position 32 from the horizontal.

Figure 4:
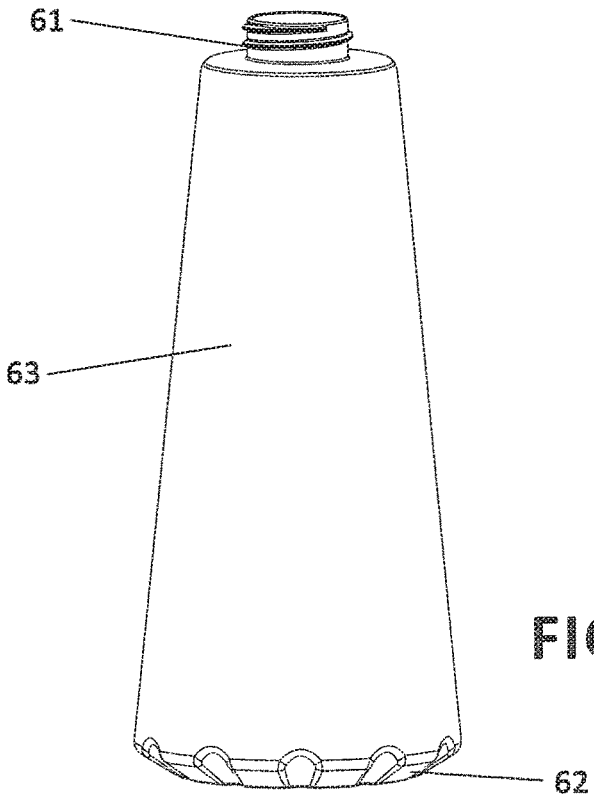
FIG. 4.—is a perspective view of the container.

FIG. 4 presents a possible solution for the container done with a blow-moulded plastic bottle 63. Container has a thread 61 in the top and a special grip, to hold the bold when disconnecting from the dispenser, in the bottom 62.

Figure 5:
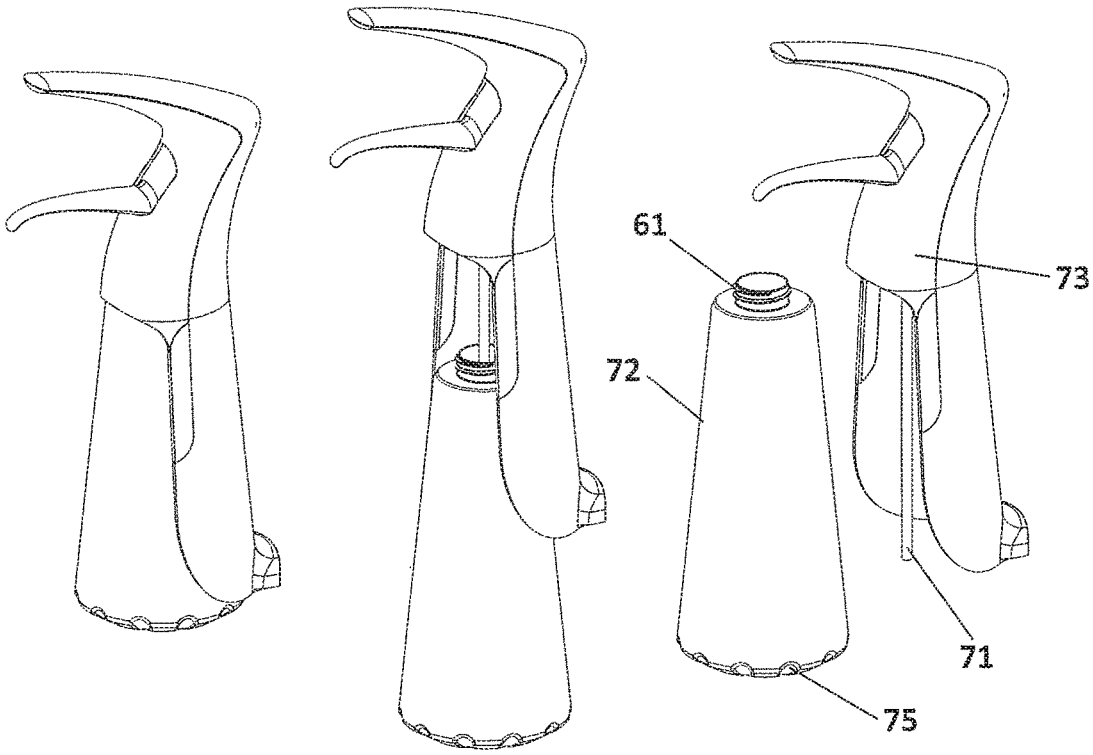
FIG. 5.—is a set of perspective views showing the recipient replacement.

FIG. 5 presents how empty container is replaced in the device. First user will unscrew the recipient 72 from the device 73 just taking the container from the bottom grip 75 and turning anti-clockwise. After removing the empty container a full one must be put just introducing the pipe 71 inside the container 72, placing the container and screwing it in clockwise direction.

Figure 6:
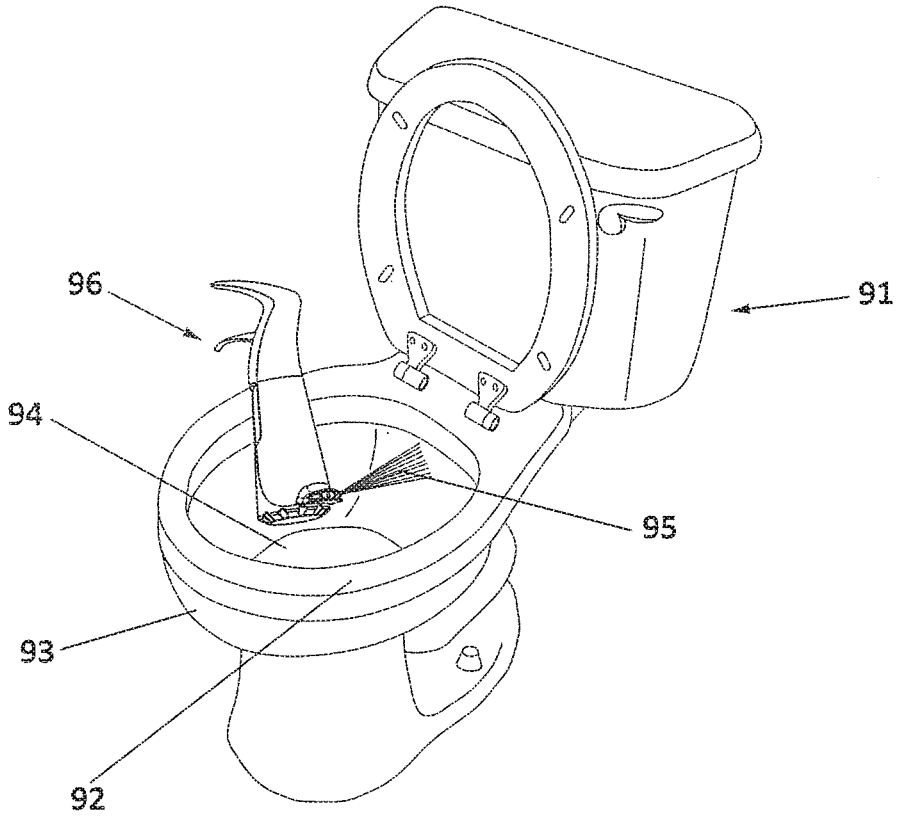
FIG. 6.—is a perspective view

FIG. 6 illustrates the ability of the cleaning system to spray up underneath the rim 92 of a toilet bowl 93. The unique packaging and ergonomic shape of the present invention allows the upright spray of product 95 even though the user doesn't need to put the hand inside the toilet. This shape is necessary to avoid collision between the body of the recipient 96 and the toilet bowl 93, and to keep the package out of the toilet 91 and far away from the toilet water 94. The spray nozzle allows for the spray 95 to be upwards at a sharp angle and sprayed from a point inside the bowl of the toilet. The present cleaning system may be used to clean all the other exterior and interior parts of the toilet 91 by spraying upright and optimizing a standing position of user.

The invention claimed is:

1. A device for cleaning surfaces, comprising an elongated housing having an upper part and a lower part, wherein the upper and lower parts are placed at opposite ends of the housing, wherein the housing is connected to a bottle, wherein the bottle contains a cleaning and/or a disinfecting liquid composition, the device further comprising a stationary handle arranged at the upper part of the housing and a pumping mechanism for pressurizing said liquid composition, and at least one nozzle for the output of said liquid composition, wherein the at least one nozzle is in fluid communication through a conduit of the device with said pumping mechanism and wherein the pumping mechanism is arranged at the upper part of said housing and said at least one nozzle is arranged at the lower part of the housing, and wherein the pumping mechanism comprises a levered trigger configured to activate the pressurizing of the liquid composition when moved toward the handle, and wherein the at least one nozzle arranged such that the angle of the direction of the expelled liquid composition upon operation of the pumping mechanism is from about 0° to about 85° downward and/or upward from a horizontal plane when the bottle rests flat on a horizontal surface.

2. The device for cleaning surfaces according to claim 1, characterized in that the bottle is detachably connected to the housing.

3. The device for cleaning surfaces according claim 1, characterized in that the device comprises two or more nozzles.

4. The device for cleaning surfaces claim 1, characterized in that the device can spray, mist or foam the liquid composition.

5. The device for cleaning surfaces according claim 1, characterized in that the bottle cannot be refilled or reused.

6. The device according to claim 1 wherein the bottle has a substantially flat surface configured for resting the device upright on the horizontal surface.

* * * * *